US006729084B2

(12) United States Patent
Neal

(10) Patent No.: US 6,729,084 B2
(45) Date of Patent: May 4, 2004

(54) KIT AND METHOD FOR BUILDING A WALL OF A LOG STRUCTURE, SUCH AS A LOG CABIN

(76) Inventor: Frank Neal, 953 Apple Valley Rd., Lyons, CO (US) 80540

( * ) Notice: Subject to any disclaimer, the term of this patent is extended or adjusted under 35 U.S.C. 154(b) by 53 days.

(21) Appl. No.: 10/172,969

(22) Filed: Jun. 18, 2002

(65) Prior Publication Data

US 2003/0230037 A1 Dec. 18, 2003

(51) Int. Cl.[7] ..... E04B 1/10

(52) U.S. Cl. ..... 52/233; 52/745.09; 52/747.1; 446/106

(58) Field of Search ..... 52/233, 745.09, 52/747.1; 446/106

(56) References Cited

U.S. PATENT DOCUMENTS 4,034,527 A 7/1977 Jalasjaa
4,391,067 A 7/1983 Frady et al.
4,742,657 A 5/1988 Veech
4,951,435 A * 8/1990 Beckedorf ..... 52/233
5,020,289 A 6/1991 Wrightman
5,577,357 A * 11/1996 Civelli ..... 52/233
5,601,849 A 2/1997 Dunstan et al.
6,023,895 A 2/2000 Anderson
6,543,193 B2 * 4/2003 Houseal ..... 52/233

* cited by examiner

*Primary Examiner*—Robert Canfield
(74) *Attorney, Agent, or Firm*—Westerman, Hattori, Daniels & Adrian, LLP

(57) ABSTRACT

Disclosed is a kit for building a wall. It includes a first log having a substantially cylindrical surface and at least one axially-extending groove formed in the substantially cylindrical surface, a second long and an elongated chink. The first log, the elongated chink, and the second log are collectively adapted for mutual contact such that both the first log and an axially-extending protruding surface of the first elongated chink abut the second log to form a first chamber bounded in part by the first log, the first elongated chink, and the second log.

12 Claims, 2 Drawing Sheets

KIT AND METHOD FOR BUILDING A WALL OF A LOG STRUCTURE, SUCH AS A LOG CABIN

This invention relates to both a kit and a method for building the wall(s) of a log structure, such as a log cabin. The kit and the method involve the use of a chink which joins two logs together in parallel, resulting in a substantially air-tight seal between the logs of the structure. This seal promotes insulation of the structure interior from the outside elements and permits water to run down and off the exterior wall of the structure.

There have been many attempts in the art to achieve a satisfactory kit and method for building log structure walls; however, most suffer from poor insulation and water run-off problems or involve complicated construction steps.

U.S. Pat. No. 5,020,289 to Wrightman discloses a "tongue and groove" log joint for making a structure. As shown in FIG. 3 of that reference, a pair of grooves 88 are formed in the lower edge 72 of the overlying log 12. The grooves 88 are spaced from one another by a longitudinally extending ridge 90. The grooves 88 have outer side walls 92 each formed with caulking shoulders 94 which are arranged to cooperate with the caulking 90 of the underlying log to provide caulking cavities 96 therebetween.

U.S. Pat. No. 4,742,657 to Veech discloses a cabin made with a spline joint tab located within a corner formed by the intersection of horizontal and vertical slots. Tab 126 covers and seals the joints where the horizontal and vertical splines meet.

U.S. Pat. No. 5,601,849 to Dunstan discloses a log structure in which logs are joined by chinking structures 30 and 32, as shown in FIG. 1 of that reference.

SUMMARY OF THE INVENTION

The present invention is a kit for building a wall, for instance the wall of a log structure, such as a log cabin. It includes a log with a substantially cylindrical outer surface and an axially-extending groove formed in its surface, an elongated chink having an axially-extending inserting surface and an axially-extending protruding surface. The elongated chink is sized and shaped to fit into the axially-extending groove with a portion of the elongated chink protruding therefrom. The axially-extending inserting surface for facing the interior of a first log and the axially-extending protruding surface for facing the exterior of the first log.

The invention also includes a second log having a substantially cylindrical surface. The first log, the first elongated chink, and the second log are adapted for mutual contact such that both the first log and the axially-extending protruding surface of the elongated chink abut the second log to form a first chamber bounded in part by the first log, the elongated chink, and the second log. The axially-extending protruding surface of the first elongated chink has a curved shape matching and abuttingthe curved shape of the substantially cylindrical surface of the second log.

DETAILED DESCRIPTION OF THE INVENTION

The present invention is directed to a kit and a method for making a log wall, for instance the walls of a log structure, such as a log cabin. The focus of the invention is a system for joining logs together. Other details of making a log structure are known in the art and are disclosed in U.S. Pat. No. 4,034,527 to Jalasjaa, U.S. Pat. No. 4,391,067 to Frady, and U.S. Pat. No. 6,023,895 to Anderson which are incorporated herein by reference in their entirety.

The present invention is a kit for building a wall, for instance the wall of a log structure, such as a log cabin. It includes a log with a substantially cylindrical surface and an axially-extending groove formed in its surface, an elongated chink having an axially-extending inserting surface and an axially-extending protruding surface. The elongated chink is sized and shaped to fit into the axially-extending groove with a portion of the elongated chink protruding therefrom. The axially-extending inserting surface for facing the interior of log and the axially-extending protruding surface for facing the exterior of said first log.

The invention also includes a second log having a substantially cylindrical surface. The first log, the first elongated chink, and the second log are adapted for mutual contact such that both the first log and the axially-extending protruding surface of the elongated chink abut the second log to form a first chamber bounded in part by the first log, the elongated chink, and the second log. The axially-extending protruding surface of the first elongated chink has a curved shape matching the curved shape of the substantially cylindrical surface of the second log.

Figure 1:
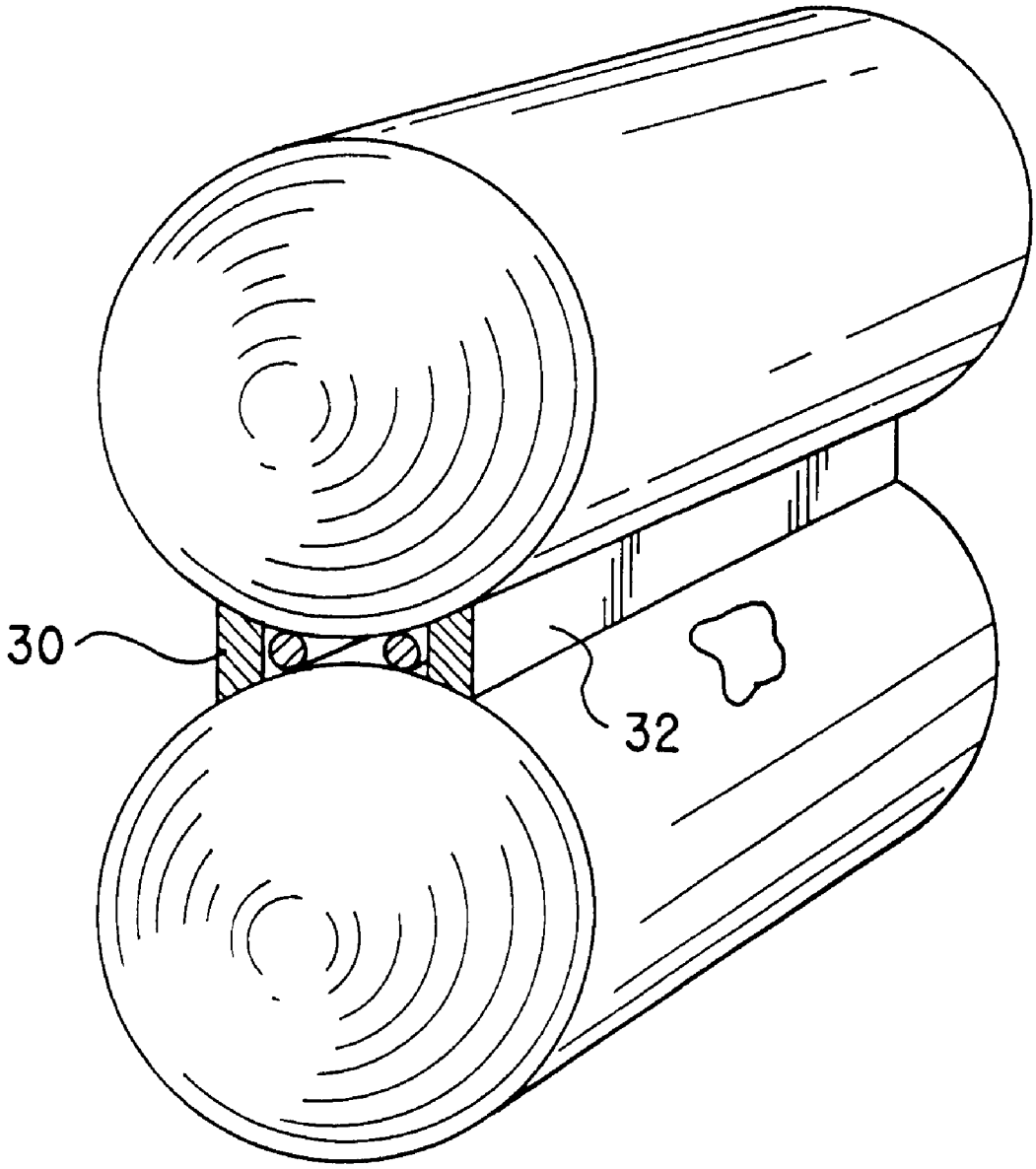
FIG. 1 PRIOR ART
FIG. 1 is a cross-sectional view of a prior art joining of logs in which the logs are cut to create flat, abutting surfaces.
Figure 2:
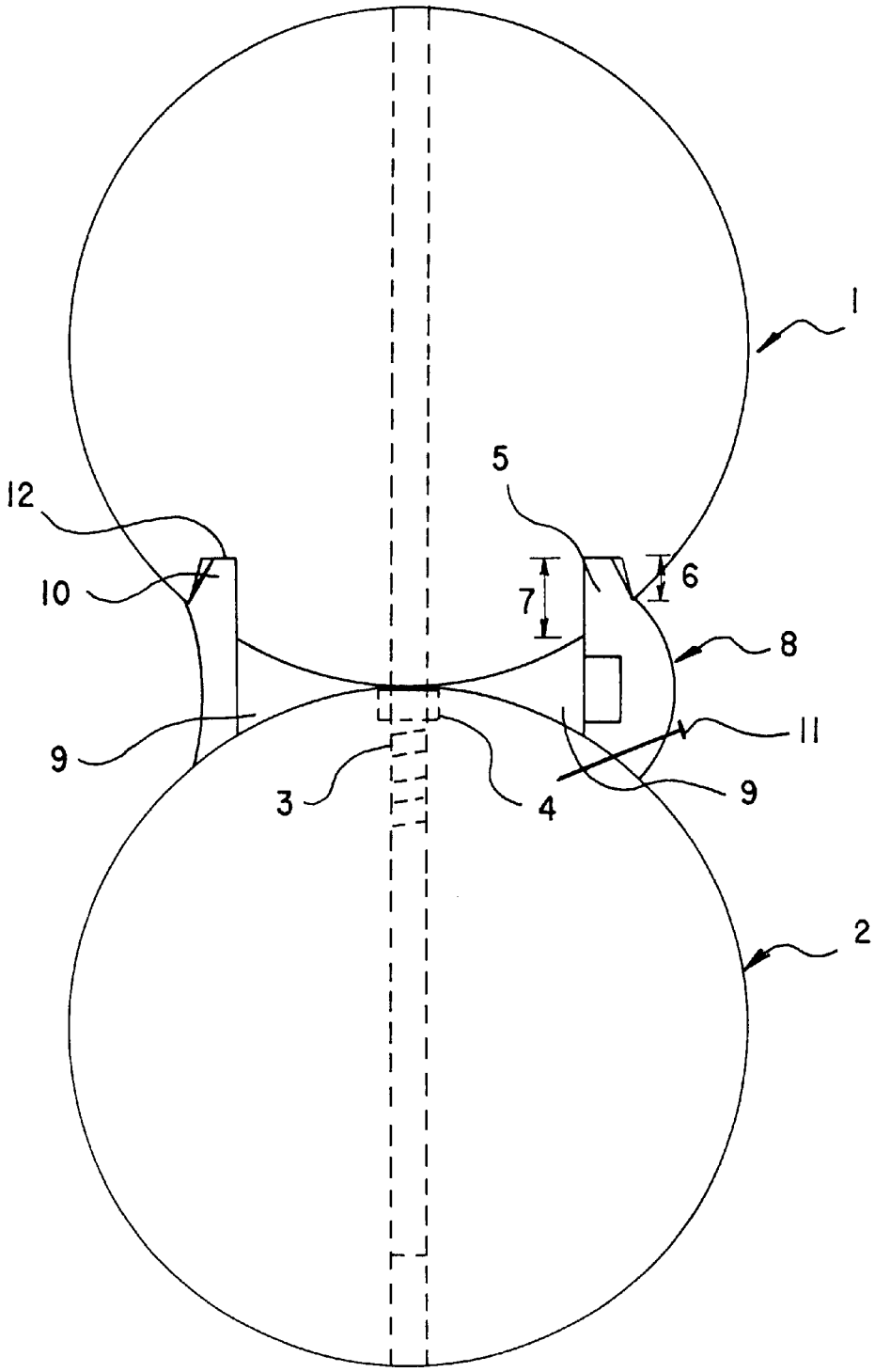
FIG. 2 is a cross-sectional view of a kit according to the present invention showing a log and groove system with a curved chink lodged in the groove.

FIG. 2 is a cross-sectioned view of the kit according to the present invention. A first log 1 is positioned parallel and atop second log 2. In this particular embodiment, the diameter of the logs is 10 inches, though this diameter value is not particularly limited. The logs may be held together through a screw 3 and a nut 4 assembly, the screw 3 running through logs 1 and 2 in a transverse direction. Other systems for maintaining first log 1 and second log 2 in place are known in the art.

Cut into the axial surface of log 1 is Groove 5. Groove 5 may be machined to promote insertion of chink 8. The embodiment shown in FIG. 2, has outer height of 6 of 1" and an inner height 7 of ⅝" to 1 ⅜", more preferably ⅞" to 1 ⅛", most preferably 1". Preferably, the inner height is 1 ½" to 1", more preferably 1 ⅛" to 1 ⅜", most preferably 1 ¼".

Inserted within groove 5 is chink 8, which is preferably made of wood but could be made of metal or a hard-setting polymer composition. In the embodiment shown in FIG. 2, chink 8 has an interior width of ½" and an exterior width of 1 ⅜". Chink 8 is dimensioned to fit snugly and tightly within groove 5 and to match and abut log 2.

Gap 9 is formed between log 1, log 2 and chink 8. Gap 9 may be profitably utilized by insertion of wiring or insulation.

Log 1 may also have a second groove 10 extending along it's axial length. The dimensions of the second groove are not particularly limited. Groove 10 may be filled with a material known as liquid nail 12 of by a second chink, not shown.

Preferably, a finishing nail 11 extends through the chink 8 and into log 2, and/or through liquid nail 12 into log 2.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the claims which follow.

What is claimed is:

1. A kit for building a wall, comprising:

a first log having a substantially cylindrical surface and at least one axially-extending groove formed in said substantially cylindrical surface;

a first elongated chink including an axially-extending inserting surface and an axially-extending protruding surface, said first elongated chink being sized and shaped to fit in said axially-extending groove with a portion of said first elongated chink protruding therefrom, said axially-extending inserting surface for facing the interior of said first log and said axially-extending protruding surface for facing the exterior of said first log; and a second log having a substantially cylindrical surface;

said first log, said first elongated chink, and said second log being collectively adapted for mutual contact such that both said first log and said axially-extending protruding surface of said first elongated chink abut said second log to form a first chamber bounded in part by said first log, said first elongated chink, and said second log, and the axially-extending protruding surface of said first elongated chink having a curved shape matching the curved shape of the substantially cylindrical surface of the second log.

2. The kit of claim 1, further comprising:

a second axially-extending groove formed in said substantially cylindrical of said first log; and a second elongated chink including an axially-extending inserting surface and an axially-extending protruding surface, said second elongated chink sized and shaped to fit in said second axially-extending groove with a portion of said second elongated chink protruding therefrom, said axially-extending inserting surface of said second elongated chink for facing the interior of said first log and said axially-extending protruding surface for facing the exterior of said first log;

said first log, said second elongated chink, and said second log being collectively adapted for mutual contact such that the first axially-extending protruding surface of said second elongated chink abuts said second log to form a second chamber bounded in part by said first log, said second elongated chink, and said second log, and the axially-extending protruding surface of said second elongated chink having a curve shape matching the curved shape of the substantially cylindrical surface of the second log.

3. The kit of claim 1, further comprising:

insulating material for insertion into said first chamber.

4. The kit of claim 2, further comprising:

insulating material for insertion into said second chamber.

5. A building structure, comprising:

at least one wall formed using the kit of claim 1.

6. A building structure, comprising:

at least one wall formed using the kit of claim 2.

7. A building structure, comprising:

at least one wall formed using the kit of claim 3.

8. A building structure, comprising:

at least one wall formed using the kit of claim 4.

9. A method for building a wall, comprising:

forming at least one axially-extending groove in a substantially cylindrical surface of a first log;

inserting a first elongated chink into one of said at least one axially-extending groove so that a portion of said first elongated chink protrudes therefrom, said first elongated chink including an axially-extending inserting surface for facing the interior of said first log and an axially-extending protruding surface for facing the exterior of said first log; and abutting said first log and said axially-extending protruding surface of said first elongated chink against a second log to form a first chamber bounded in part by said first log, said first elongated chink, and said second log the axially-extending protruding surface of said first elongated chink having a curved shape matching the curved shape of the substantially cylindrical surface of the second log.

10. The method of claim 9, further comprising:

forming a second axially-extending groove in said substantially cylindrical surface of said first log;

inserting a second elongated chink into said second axially-extending groove so that a portion of said second elongated chink protrudes therefrom, said second elongated chink including an axially-extending inserting surface for facing the interior of said first log and an axially-extending protruding surface for facing the exterior of said first log; and abutting said axially-extending protruding surface of said second elongated chink against said second log to form a second chamber bounded in part by said first log, said second elongated chink, and said second log, the axially-extending protruding surface of said second elongated chink having a curved shape matching the curved shape of the substantially cylindrical surface of the second log.

11. The method of claim 9, further comprising:

inserting insulating material into said first chamber.

12. The method of claim 10, further comprising:

inserting insulating material into said second chamber.

* * * * *